US008979188B2

(12) United States Patent
Crabtree, Jr. et al.

(10) Patent No.: US 8,979,188 B2
(45) Date of Patent: Mar. 17, 2015

(54) COLLAPSIBLE SINGLE LEG SITTING DEVICE

(71) Applicants: Walden Blaine Crabtree, Jr., Raleigh, NC (US); Lee Thomas Gately, Raleigh, NC (US)

(72) Inventors: Walden Blaine Crabtree, Jr., Raleigh, NC (US); Lee Thomas Gately, Raleigh, NC (US)

( * ) Notice: Subject to any disclaimer, the term of this patent is extended or adjusted under 35 U.S.C. 154(b) by 0 days.

(21) Appl. No.: 13/967,962

(22) Filed: Aug. 15, 2013

(65) Prior Publication Data

US 2015/0048663 A1 Feb. 19, 2015

(51) Int. Cl.

| | |
|---|---|
| ***A47C 13/00*** | (2006.01) |
| ***A47C 4/00*** | (2006.01) |
| ***A47C 3/20*** | (2006.01) |
| ***A45B 5/00*** | (2006.01) |

(52) U.S. Cl.

CPC .... *A47C 4/00* (2013.01); *A45B 5/00* (2013.01)
USPC ..... 297/129; 297/16.2; 297/338; 135/66; 135/75

(58) Field of Classification Search

CPC ..... A47C 9/027; A47C 9/025; A47C 9/10
USPC ..... 297/4, 338, 16.2, 129; 135/66, 75
See application file for complete search history.

(56) References Cited

U.S. PATENT DOCUMENTS

| | | | | | |
|---|---|---|---|---|---|
| 504,326 | A | * | 9/1893 | Chapman | 248/155.1 |
| 1,324,554 | A | * | 12/1919 | Kozlowski | 43/18.1 CT |
| 1,400,394 | A | * | 12/1921 | Warry | 135/69 |
| 1,456,304 | A | * | 5/1923 | Fritschka | 248/155.1 |
| 1,697,552 | A | | 1/1929 | Brooks | |
| 1,957,033 | A | | 5/1934 | Silverman | |
| 2,690,211 | A | * | 9/1954 | Wentz | 248/155.1 |
| 2,705,015 | A | * | 3/1955 | Langlais | 52/632 |
| 3,165,077 | A | | 1/1965 | Olson | |
| 3,912,209 | A | | 10/1975 | Turpin | |
| 3,987,807 | A | * | 10/1976 | Varnell | 135/66 |
| 4,351,348 | A | * | 9/1982 | Axton | 135/66 |
| 4,407,318 | A | * | 10/1983 | Stuever | 135/66 |
| 5,720,522 | A | | 2/1998 | Habeck | |
| D414,348 | S | | 9/1999 | Habeck | |
| 6,192,908 | B1 | | 2/2001 | Smith | |
| 6,938,927 | B1 | * | 9/2005 | Martin et al. | 280/819 |
| 7,316,449 | B2 | * | 1/2008 | Lynch et al. | 297/4 |
| 7,654,275 | B2 | * | 2/2010 | Ewell et al. | 135/66 |
| 8,657,351 | B2 | * | 2/2014 | Johnson | 294/19.2 |
| 2008/0007098 | A1 | * | 1/2008 | Girard | 297/195.1 |
| 2012/0145206 | A1 | * | 6/2012 | Parry et al. | 135/66 |

FOREIGN PATENT DOCUMENTS

| | | | |
|---|---|---|---|
| CN | 102302259 | A * | 1/2012 |
| CN | 202664484 | U * | 1/2013 |
| JP | 2005034395 | A * | 2/2005 |

OTHER PUBLICATIONS

Collapsible Walking Stick, Lulusoso.com, http://sell.lulusoso.com/selling-leads/689401/Collapsible-Walking-Stick-walking-stick-cane, Mar. 11, 2012, US.

Tube, Dictionary.com, http://www.dictionary.reference.com/browse/tube?s=t, Nov. 11, 2014.

* cited by examiner

*Primary Examiner* — Milton Nelson, Jr.
(74) *Attorney, Agent, or Firm* — James G. Passé; Passé Intellectual Property, LLC

(57) ABSTRACT

The present invention is a single leg sitting device which has a collapsible leg which fits inside the seat for compact transportation or to turning the seat into a walking stick.

13 Claims, 10 Drawing Sheets

COLLAPSIBLE SINGLE LEG SITTING DEVICE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to improvements in single leg sitting devices. In particular, the present invention relates to a single leg seating device which can have multiple other uses and collapses down to a compact format.

2. Description of Related Art

The availability of portable sitting devices is very well know with tens if not hundreds of designs for easy to carry portable seating. Single leg canes with fold out seats or otherwise attached separate seats and the like are very common as are two, three and four legged seating devices. In traveling from place to place the idea of having something lightweight and easy to transport, yet provide convenient seating of the individual carrying the device is the motivation behind these devices. Folding devices assume that the folded devices are easier to carry since it is shorter than the expanded device. While true, the width increases and makes it less convenient without a larger carrying device. Likewise, devices utilized as walking canes provide a dual purpose; however, if a walking cane is not needed then one is reduced to carrying around a cane with no purpose until it is needed as a seat.

While each of the prior devices has their uses and popularity, or lack thereof, it is clear that there are situations where the lightest or most compact seating device would be the best device to use. For example, waiting in lines, attending events with periods of long wait such as sporting events, engaging in activities, work situations or the like where there is no provided seating can be near impossible for some people especially those with physical limitations such as the elderly and the disabled. A bulky seating device is just not a practical solution for folks who are in a situation where carrying something bulky is not practical or desired. Accordingly, the market is always looking for a more compact way to provide individual seating that is easily transported and cost effective.

BRIEF SUMMARY OF THE INVENTION

The present invention is the discovery that a single leg seating device, wherein the leg telescopes and fits within the seat as if by telescoping, the seat becoming the carrying case, addresses the problems of the current portable seating as well as other problems associated with portable seating.

Accordingly, in one embodiment, the present invention is a single leg sitting device comprising:

a) a telescoping leg portion having a top of the leg, a bottom of the leg, an expanded configuration and a collapsed configuration; and b) a seat portion comprising a tube having a length and ends with at least one open end configured to receive the leg in the collapsed configuration and with an attachment area along the tube length to receive the top of the leg to form a t-configuration.

DETAILED DESCRIPTION OF THE INVENTION

Figure 1:
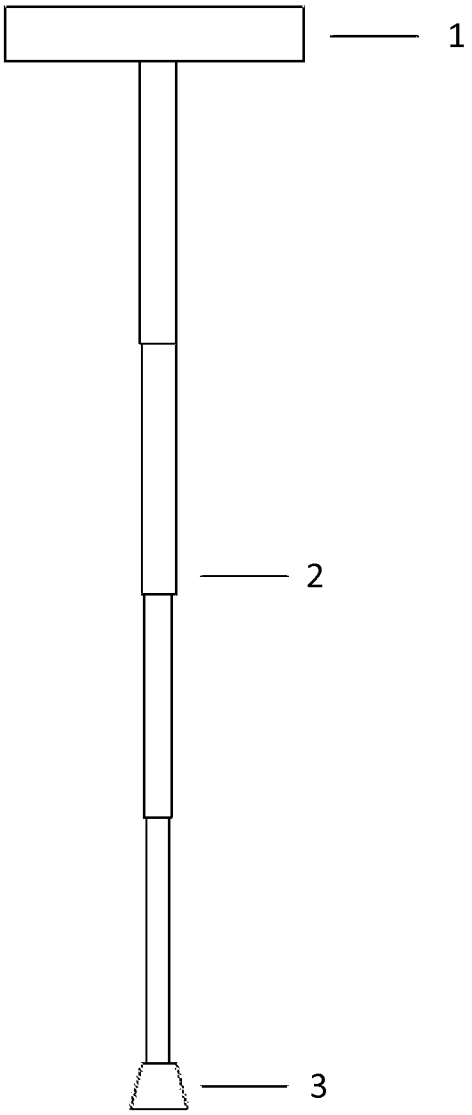
FIG. 1 is a simple side view of the present invention, configured for use as a seat.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and 'essentially' mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

Figure 4:
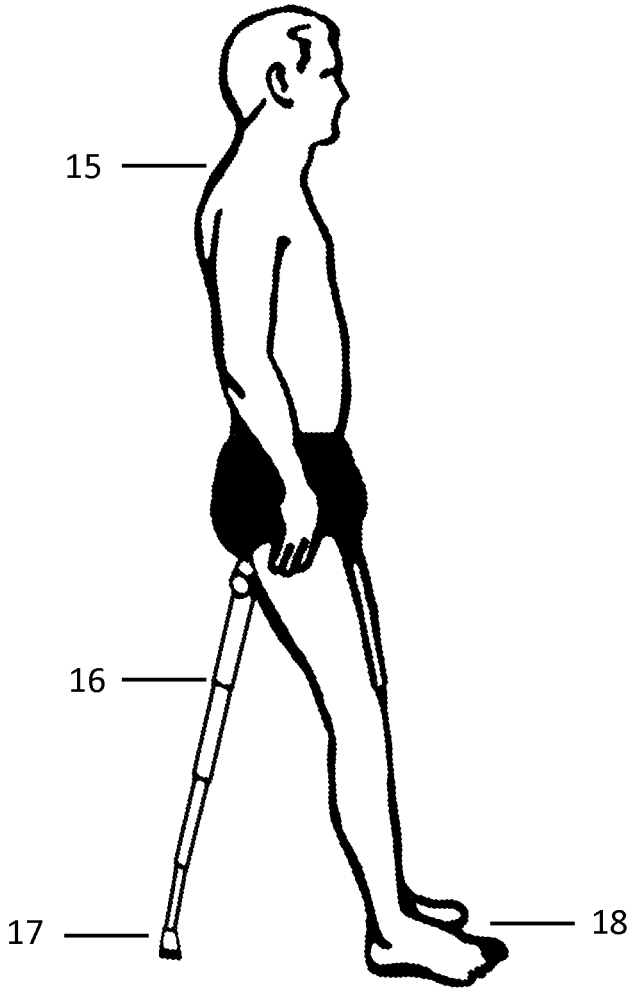
FIG. 4 shows the seat in use.

As used herein the term "single leg sitting device" refers to a device having a leg portion for height of the device and a seat portion mounted on the leg portion such that a seat is formed between the users two legs and the single leg of the seat, the users weight holding everything in place for example as shown in FIG. 4.

As used herein the term "telescoping leg portion" refers to a tubular leg with a plurality of section each section slightly smaller than the next from the top of the leg to the bottom of the leg such that the sections may collapse into one another. Each section has a top and bottom and the sections may each be of either fixed or tapered diameter. In one embodiment, there are 2, 3, 4, 5, 6, or more sections. The entire length of the expanded leg is determined by the height needed for the seat, and the collapsed size depends on the section lengths. The leg portion must lock into place in the expanded configuration (or lock into multiple expanded configurations) so that upon sitting on the seat the leg does not collapse. In the closed or collapsed configuration the leg portion may lock but it is not required to do so. The leg portion may have a device for holding the leg in the seat, preventing it from falling out during use or transport. The leg may be shock corded to aid in expanding, collapsing and locking of the leg portion.

In one embodiment, the leg portion telescopes via a button and channel configuration, an example of which is shown in the figures. In this configuration, a button slides within a channel between a collapsed configuration and an expanded configuration. There may be just one expanded configuration, or multiple open configurations to allow for adjusting the length of the leg portion and still lock it in place.

Figure 3:
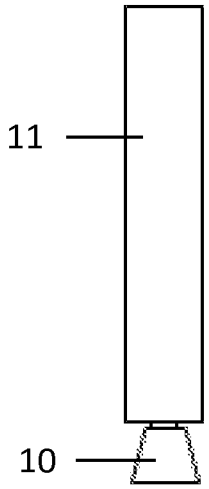
FIG. 3 shows a side view of the leg portion collapsed and stored within the seat portion.

As used herein the term "seat portion" refers to a tubular section which can receive the collapsed leg portion and form a carrying case, e.g. as shown in FIG. 3. It can be padded if desired by wrapping or applying padding material. The material the seat and leg is made of can be any material that will support the weight of someone when used as a seat, so metals (steal aluminum and the like), carbon fiber and the like can be utilized. In one embodiment, one end of the seat portion is open to receive the collapsed leg portion, while the other end is closed to prevent the leg from falling out the other end. In one embodiment, there is a locking mechanism holding the cover/seat portion on the leg portion. Along the length of the seat portion is a device for attaching the seat portion to the leg portion to for the single leg seat as shown in FIG. 1. In one embodiment, there is a hole in the seat portion along its length for inserting the leg portion and forming the seat. There can be a stop of some kind to prevent the leg from passing entirely through the seat as shown in the figures. Other attachment means can be utilized to create an essentially t-configuration of the seat on the leg.

In other embodiments, the seat portion can be moved to other positions to create a walking stick (one long straight stick) or other configurations all of which collapse down to a small configuration. In other embodiments, there is a foot attachment that fits onto the bottom of the leg portion such as used on canes or leg devices or the like.

The device of the present invention can be made with tubing of any particular material strong enough to support the weight of an individual such as aluminum, steel or other metal or carbon fiber or the like. One skilled in the art can fabricate the device of the present invention without undue experimentation in view of the disclosure herein using techniques such as metal formation, welding, drilling, molding and the like.

Now referring to the drawings FIG. 1 is a side view of an embodiment of the present invention showing a seat portion 1 being a horizontal tube and attached to it in a t-configuration a 4-section collapsible leg portion 2. As shown in this view, there is a foot 3 attached to the bottom of the leg 2.

Figure 2:
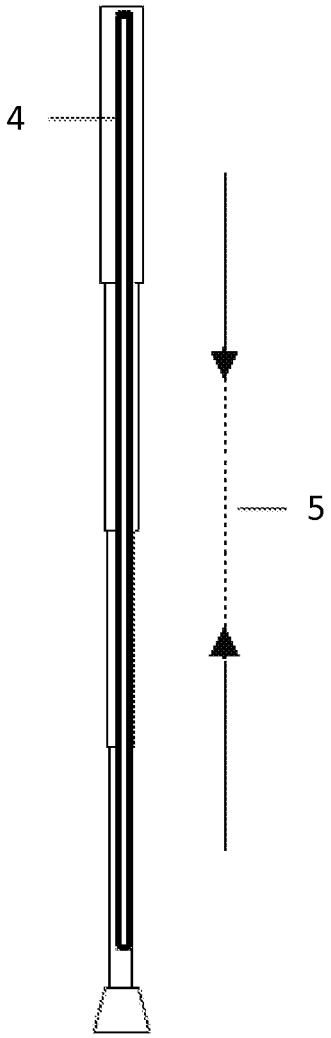
FIG. 2 shows details of a shock cord inside the leg portion in the present invention.

FIG. 2 depicts a side view of a leg of the present invention, showing the inside of the leg where a shock cord 4 is positioned. In this embodiment, the shock cord is an elastic circular band which aids in the expanding, collapsing, and locking of the legs. The arrows 5 indicate how i.e. the direction the leg will collapse.

In FIG. 3 there is depicted the device of the present invention with the leg portion 10 completely telescoped down and the seat portion 11 covering the leg portion 10 such that the entire device is only slightly larger than the seat portion 11 fitting almost entirely inside. In this embodiment, only the foot sticks out.

FIG. 4 depicts a perspective of a user 15 sitting on seat 16 of the invention. A stable 3 point seating arrangement is achieved by point 17 on the seat and the users feet 18.

Figure 5:
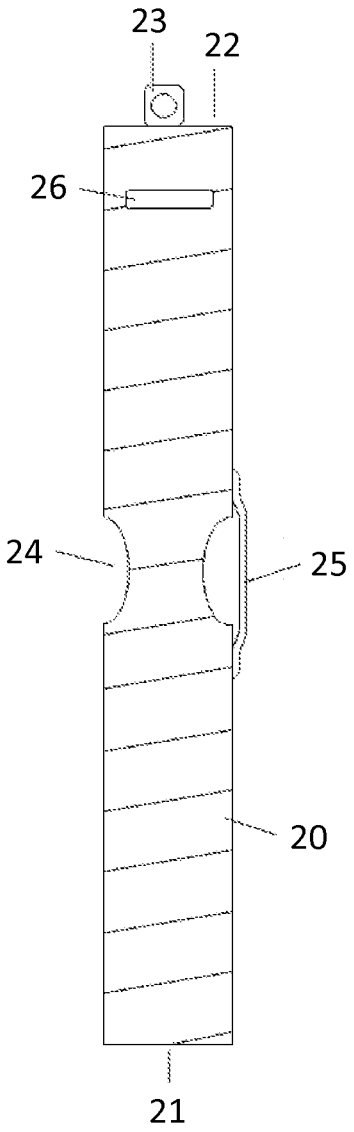
FIG. 5 is a side view of a seat portion showing a leg attachment area.

FIG. 5 is a front view of the present invention, configured for use as a seat. Seat 20 is tubular having open end 21. The opposite end of the seat 10 is fitted with a cap 22 having a opening 23 for hanging the device or a belt hook or other attachment device. The leg portion fits into seat opening 24 and stop bracket 25 supports the leg when inserted into seat opening 24. Slot 26 is designed to receive a button from the leg portion (from the top of the leg portion) to hold the leg section in the seat both when the leg is fully collapsed (for device storage/transport), and when the leg is fully expanded when using the device as a walking cane.

Figure 6:
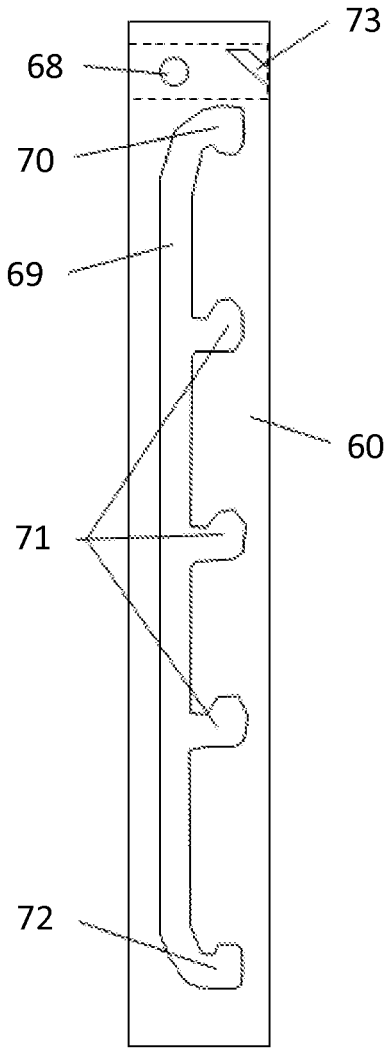
FIGS. 6 to 9 show an example of the sections of a leg using the button and channel method of collapsing and expanding the leg portion.
Figure 7:
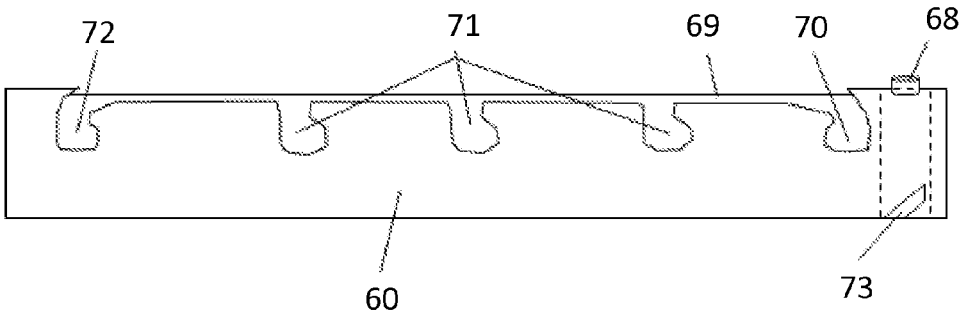

FIGS. 6 through 9 depict side views of an embodiment of the leg portion wherein there are 4 sections and wherein there is an example of a button and channel configuration with 5 positions for adjusting length. FIG. 6 is the uppermost section 60 comprising snap button 68 which rides and locks inside of the seat during storage configuration. A tube slide channel 69 is shown for expanding or collapsing the interlocked nesting leg sections. Top tube lock position 70 is a lock position for the lowest height adjustment and for fully collapsed leg sections. Intermediate pole lock positions 71 graduate various positions for height adjustments. The bottom leg lock position 72 is for the highest height adjustment and for the fully expanded leg portion. A tab or hook 73 is shown for attaching a shock cord or band. FIG. 7 is a side view of the top section shown in FIG. 6.

Figure 8:
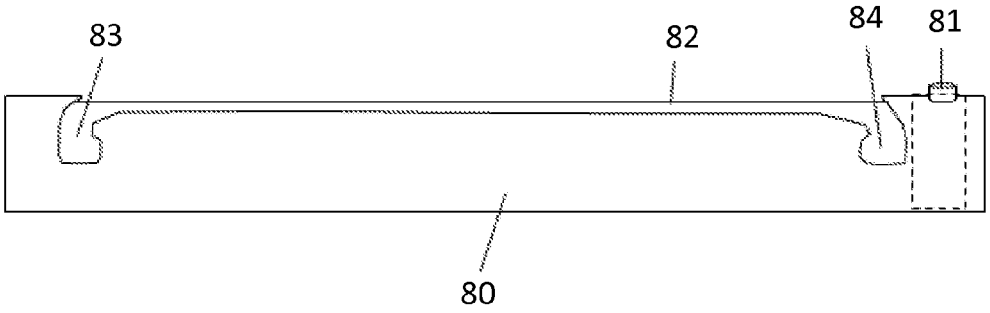

FIG. 8 is a side view of the two middle section tubes 80. The tubes have a locking button 81 a channel 82 and lock positions 83 and 84. The buttons from each of the two middle sections ride in the channel of the leg section above them. The lower of the two leg sections is slightly smaller in diameter in order to fit inside the upper of the two leg sections.

Figure 9:
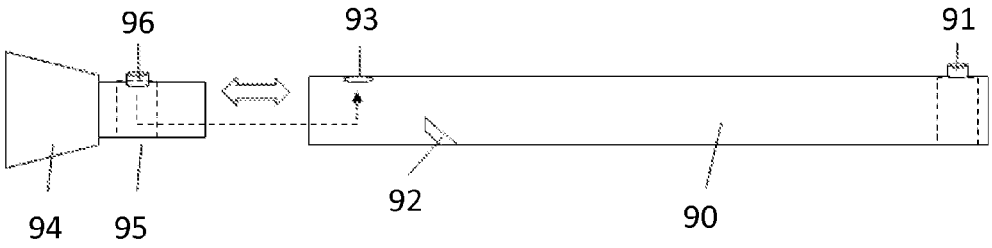

FIG. 9 is a bottom section embodiment of the leg portion the section 90 consists of button 91 which rides in the channel of the section above. It has a tab or hook 92 for attaching the other end of the shock cord and a foot attachment locking hole 93. A foot attachment 94 is shown having a lock button 96 and a foot attachment pole 95 which slides into the bottom of the lowest section 90.

Figure 10:
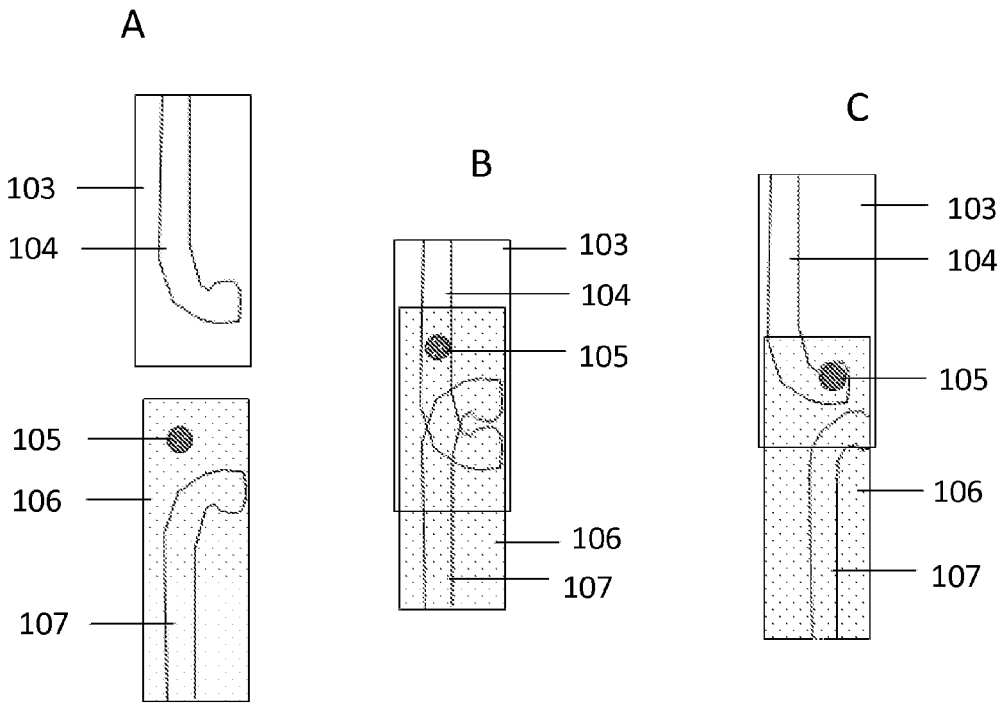
FIG. 10 A, B and C shows a leg portion assembled with the channel and button arrangement.

FIG. 10 A, B and C shows in succession how two arbitrary leg sections (i.e., could be legs 1 and 2, or 2 and 3, or 3 and 4, etc.) are assembled, and how they slide and lock using the channels and snap buttons. Fig. A shows how the inner/lower leg section 106 fits snugly inside of the outer/upper leg section 103. The snap button 105 of leg section 106 (which also has its own channel 107), is depressed during assembly to allow leg section 106 to fit into leg section 103. FIG. 10B shows how the snap button 105 pops out in the channel 104 of leg section 103, and rides in that channel as leg section 106 slides (telescopes) up and down inside of leg section 103. Once assembled, the snap button 105 prevents leg section 106 from falling out of leg section 103. FIG. 10C shows that when the legs are locked in their expanded configuration, the snap button 105 of leg section 106 sits in the locking position (i.e., the bottom, upwardly-curved end) of channel 104 of leg section 103.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A single leg sitting device comprising:

a) a telescoping leg portion having a top of the leg portion, a bottom of the leg portion, an expanded sitting configuration and a collapsed storage configuration; and b) a seat portion consisting essentially of a hollow tube having a length and ends with at least one open end configured to receive the leg portion in the collapsed storage configuration inside the hollow seat portion and with an attachment area along the tube length to removably receive the top of the leg portion through the hollow seat portion to form a t-configuration sitting device.

2. The sitting device according to claim 1 which further comprises a shock cord positioned in the telescoping leg portion.

3. The sitting device according to claim 1 wherein the expanded configuration locks in place.

4. The sitting device according to claim 1 wherein the telescoping leg portion can be locked in place in a plurality of lengths.

5. The sitting device according to claim 1 wherein the seat portion open end can be positioned on the top of the telescoping leg portion in the expanded sitting configuration to form a walking stick.

6. The sitting device according to claim 1 wherein the leg portion has a foot attachment positioned at the bottom of the leg.

7. The sitting device according to claim 1 wherein the seat portion attachment area is a hole configured to receive the top of the leg portion.

8. The sitting device according to claim 1 wherein the leg portion fits almost entirely within the seat portion.

9. The sitting device according to claim 1 wherein the seat portion forms a carrying case for the collapsed leg portion.

10. The sitting device according to claim 1 wherein there are 4 sections to the leg portion.

11. The sitting device according to claim 1 wherein there is a stop bracket to support the leg portion that is through the hollow seat portion.

12. The sitting device according to claim 1 wherein the leg portion length is adjusted with a button and channel leg length configuration.

13. The sitting device according to claim 12 wherein there is a plurality of button lock positions to provide a plurality of leg lengths.

* * * * *